US012042048B1

(12) United States Patent
Zircher

(10) Patent No.: US 12,042,048 B1
(45) Date of Patent: Jul. 23, 2024

(54) PRODUCTIVITY FACILITATING APPARATUS FOR A WORKSTATION

(71) Applicant: Tink-Q-Bator, LLC, Fleming Island, FL (US)

(72) Inventor: Dana Zircher, Los Angeles, CA (US)

( * ) Notice: Subject to any disclaimer, the term of this patent is extended or adjusted under 35 U.S.C. 154(b) by 0 days.

(21) Appl. No.: 18/133,346

(22) Filed: Apr. 11, 2023

(51) Int. Cl.

| | |
|---|---|
| ***A47B 96/18*** | (2006.01) |
| ***A47B 96/02*** | (2006.01) |
| ***A47B 96/06*** | (2006.01) |
| ***A47B 96/07*** | (2006.01) |
| *A47B 21/03* | (2006.01) |

(52) U.S. Cl.
CPC ..... *A47B 96/18* (2013.01); *A47B 96/025* (2013.01); *A47B 96/067* (2013.01); *A47B 96/07* (2013.01); *A47B 2021/0321* (2013.01); *A47B 2200/0038* (2013.01); *A47B 2220/0002* (2013.01)

(58) Field of Classification Search
CPC ..... A47B 96/07; A47B 96/067; A47B 96/025; A47B 96/18; A47B 2200/0038; A47B 2200/0002; A47B 2021/0321
USPC ..... 108/143
See application file for complete search history.

(56) References Cited

U.S. PATENT DOCUMENTS

| | | | | | |
|---|---|---|---|---|---|
| 794,809 | A * | 7/1905 | Marsh | 211/151 | |
| 1,258,230 | A * | 3/1918 | Lewis | 108/143 | |
| 2,182,703 | A * | 12/1939 | Rainwater | A47B 17/04 | 108/92 |
| 3,702,209 | A * | 11/1972 | Moore | B42F 17/08 | 312/301 |
| 4,561,619 | A * | 12/1985 | Robillard | F16M 11/048 | 248/661 |
| 4,566,325 | A * | 1/1986 | Rante | G01R 31/2805 | 248/287.1 |
| 4,637,666 | A * | 1/1987 | Worrell | A47B 21/03 | 312/196 |
| 4,732,089 | A * | 3/1988 | Mueller | A47B 21/03 | 108/143 |
| 5,104,086 | A * | 4/1992 | Ramey, III | F16M 11/046 | 248/442.2 |
| 5,402,501 | A * | 3/1995 | Silfvajt | G11B 27/028 | 381/119 |
| 5,413,294 | A * | 5/1995 | Greenquist | G06F 3/0202 | D14/460 |

(Continued)

*Primary Examiner* — Daniel J Troy
*Assistant Examiner* — Timothy M Ayres
(74) *Attorney, Agent, or Firm* — Wilson Dutra, PLLC; Camille A. Wilson

(57) ABSTRACT

The present disclosure provides for a productivity facilitating apparatus for optimizing the space and function of a workstation. According to some embodiments of the present disclosure, a productivity facilitating apparatus may comprise at least one base. In some embodiments, the productivity facilitating apparatus may comprise at least one track and at least one mobile assembly. In some aspects, the productivity facilitating apparatus may allow for potentially integrating technologies and accessories that would make them more accessible. By way of example and not limitation, the productivity facilitating apparatus may be used in a variety of industries and activities, such as music, video, and multimedia producing. In some aspects, the productivity facilitating apparatus may be used in culinary arts, artistic activities, or any industry that may benefit from optimizing a workstation using the productivity facilitating apparatus.

15 Claims, 15 Drawing Sheets

(56) References Cited

U.S. PATENT DOCUMENTS

| | | | | | |
|---|---|---|---|---|---|
| 5,452,876 | A * | 9/1995 | Hatcher | A47B 21/045 | 400/718 |
| 5,503,087 | A * | 4/1996 | Hall | B23Q 1/28 | 108/143 |
| 5,896,817 | A * | 4/1999 | Hancock | A47B 13/081 | 108/50.01 |
| 5,906,035 | A * | 5/1999 | Atkins | A47B 81/06 | 312/107 |
| 6,802,264 | B2 * | 10/2004 | Kasak | A47B 21/03 | 108/50.01 |
| 8,178,771 | B2 * | 5/2012 | Ando | H04R 1/021 | 84/718 |
| 8,498,437 | B2 * | 7/2013 | Ando | H05K 5/0226 | 381/345 |
| 8,689,704 | B2 * | 4/2014 | Hodges | A61B 46/10 | 312/319.9 |
| 9,564,982 | B2 * | 2/2017 | Ito | H04H 60/04 | |
| 2006/0027146 | A1 * | 2/2006 | Lee | A47B 19/00 | 108/6 |

* cited by examiner

800

PRODUCTIVITY FACILITATING APPARATUS FOR A WORKSTATION

BACKGROUND

Even those not involved in the audio industry would recognize the enormous audio mixers that appear in many movies, concerts, and other events. The primary function of these large devices is to accept, combine, process, and monitor audio information. Audio mixers are utilized in a variety of settings like recording studios, public address systems, broadcasting, night clubs, DJs, and more. There are many different functional sections that are included on the typical audio mixer, each attributing to the large size of the device.

One of the main components of an audio mixer is the channel input strip that allows the user to control the gain of the preamplifier, adjust the equalization of the signal of the different channels, control the routing of the input signal to the different sections on the board, and adjust the overall sound being produced. Audio mixers also have a channel equalization subsection that controls the equalization of the signal through attenuating and/or boosting the different frequency ranges. The master output control subsection allows the user to adjust the overall output of the mixer. Audio mixers also include a meter that indicates whether the signal is strong, to ensure that a strong signal is being produced. Furthermore, audio mixers contain hardware inputs and routing for other devices to plug directly into such devices to then be monitored and adjusted through the mixer.

In today's modern recording environments, most, if not all, of the analog signal processing operations described above have been reconfigured for implementation in the digital domain. These operations are now the product of computer algorithms, rather than analog acoustic physics. As a result of 'virtualizing' all of this functionality, the interfaces that facilitate execution of these tasks have also been virtualized.

The virtualization of these interfaces has caused modern recording systems to be redesigned. While the layout of the legacy analog devices was configured to allow an operator to use both hands to fine tune audio both tactically, as well as through muscle memory, even today's finest multi-touch displays fail to create such a relationship with the operator. Although many aftermarket peripheral input devices have been developed, such as fader packs, equalizers, and musical instrument digital interface (or "MIDI") controllers, which mimic the hands-on style of the older analog tactical interfaces to control the digital algorithms used in modern recording systems, most of these devices are used in small to mid-frame digital audio workstations (or "DAWs") that lack the space required to operate such peripherals correctly. This limits the number of different system control devices, including the keyboard and pointing device, that may be configured at the primary work surface, or "sweet spot," of the workstation, forcing users to make trade-offs when determining the placement of the devices to allow for maximum productivity.

A workstation configured to provide convenient access to a plurality of features, devices, and tools would be helpful for many users. Such a configuration would minimize the trade-offs users often have to consider when weighing productivity against feature assortment when designing a workspace.

SUMMARY OF THE DISCLOSURE

What is needed is a productivity facilitating apparatus to optimize the space and function of a workstation. Creating a workspace that is both easy and convenient to use can increase productivity in a variety of industries and activities. A productivity facilitating apparatus may allow one or more technologies, devices, tools, and accessories to be integrated with a workstation in a way that makes them more accessible to a user.

The present disclosure provides generally for a productivity facilitating apparatus. According to some embodiments of the present disclosure, a productivity facilitating apparatus may comprise at least one base. In some aspects, the at least one base may comprise at least two coplanar elongated members, wherein the two elongated members may be configured to interface with at least one surface. In some embodiments, the productivity facilitating apparatus may comprise at least one track and at least one support element, wherein the at least one support element connects the track to the base.

In some non-limiting exemplary embodiments, the opposing ends of the at least one support element may be removably or securely attached to at least one portion of the track and at least one portion of the base via one or more connection elements, such as one or more fasteners, adhesives, or welded connections, as non-limiting examples. In some aspects, the track may comprise at least one elongated groove, indentation, or channel. In some embodiments, the productivity facilitating apparatus may comprise at least one cross member, wherein the at least one cross member may interface with at least one portion of the base. In some implementations, the at least one cross member may be configured to removably receive at least one accessory. In some aspects, the productivity facilitating apparatus may comprise at least one support member, wherein the at least one support member may connect the at least one base to at least one portion of the track.

In some aspects, the productivity facilitating apparatus may comprise at least one mobile assembly, wherein the at least one mobile assembly may comprise at least one frame, and wherein the at least one frame may be configured for translational movement via the at least one track. In some implementations, the at least one mobile assembly may be configured to removably receive at least one accessory, such as a keyboard, mouse, or notebook, as non-limiting examples. In some embodiments, the at least one mobile assembly may be configured to move translationally in at least one direction upon the at least one track. In some aspects, the at least one mobile assembly may comprise at least one motion facilitating mechanism, such as a rolling mechanism, as a non-limiting example.

In some non-limiting exemplary embodiments, the productivity facilitating apparatus may comprise at least one attachment mechanism. In some aspects, the at least one attachment mechanism may be configured to be temporarily or permanently secured to the base or the mobile assembly. By way of example and not limitation, the attachment mechanism may be secured via a snap-fit configuration, wherein the attachment mechanism may snap into at least one portion of the track. In some implementations, the at least one attachment mechanism may comprise a hook, a cupholder, a storage receptacle, or a cord holder, as non-limiting examples. By way of example and not limitation, the productivity facilitating apparatus may be used in a variety of industries and activities, such as music, video, and multimedia producing. In some aspects, the productivity facilitating apparatus may be used in culinary arts, artistic, scholastic, or business settings, or in any industry that may benefit from optimizing a workstation using the productivity facilitating apparatus. In some aspects, the productivity facilitating apparatus may comprise at least one electrical component, such as USB connection, charging stations, audio connectors, cooling mechanisms such as fans, transmitting devices, lights, or sensors, as non-limiting examples.

BRIEF DESCRIPTION OF THE DRAWINGS

The accompanying drawings that are incorporated in and constitute a part of this specification illustrate several embodiments of the disclosure and, together with the description, serve to explain the principles of the disclosure.

DETAILED DESCRIPTION

Figure 1A:
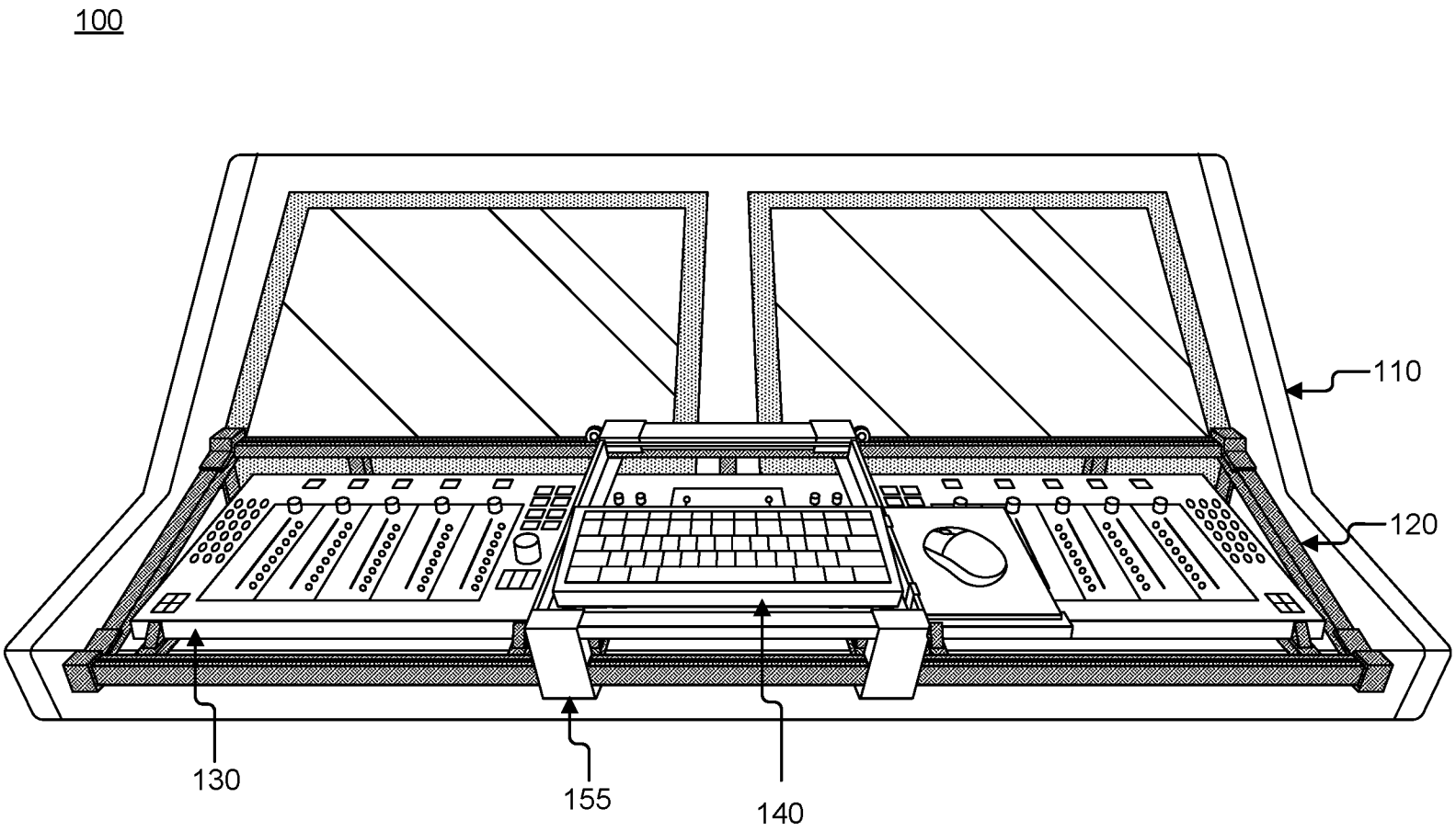
FIG. 1A illustrates an exemplary productivity facilitating apparatus integrated with a workstation, according to some embodiments of the present disclosure.

The present disclosure provides generally for a productivity facilitating apparatus to optimize the space and function of a workstation. According to some embodiments of the present disclosure, a productivity facilitating apparatus may comprise a base, wherein the base may comprise two elongated members. In some embodiments, the productivity facilitating apparatus may comprise a track and at least one support element connecting the track to the base. In some embodiments, the productivity facilitating apparatus may be integrated with one or more of a variety of workstations.

For example, the productivity facilitating apparatus may be integrated into an audio engineering workstation. In some aspects, the audio engineering workstation may comprise a plurality of digital asset composition or broadcast devices, wherein only a portion of such devices may be configured at the primary work surface of the workstation, also known as the "sweet spot." This may hinder the user's productivity while using the workstation, as the user may be forced to manually rearrange devices as they are needed, or the user may have to physically move to access different devices configured at different locations on the workstation, which may be particularly challenging for users that have physical disabilities.

To make the audio engineering workstation user-friendly, the productivity facilitating apparatus of the present disclosure may comprise a base configured to be removably or permanently secured to a top portion or surface of the workstation. In some aspects, the productivity facilitating apparatus may comprise at least one mobile assembly. In some aspects, the mobile assembly may be configured to removably receive one or more input devices, peripheral technologies, or other accessories that may be configured to be used with the audio engineering workstation. By way of example and not limitation, the mobile assembly may be configured to hold a laptop computer, a keyboard, a trackball or similar pointing device, or a notebook, as non-limiting examples. In some implementations, the mobile assembly may be configured to move via the track to alternate access to the components configured within or upon the mobile assembly and those configured underneath it on an as-needed basis. In some aspects, this may enhance user productivity by allowing the user to quickly and efficiently access all tools and devices that may help them work on or complete a task. For example, the mobile assembly may move along the track to provide access to an audio mixer that may be temporarily blocked by the mobile assembly when one or more components within or upon the mobile assembly are needed, wherein the mobile assembly may be pushed or slid out of the way when the audio mixer needs to be accessed by the user.

In the following sections, detailed descriptions of examples and methods of the disclosure will be given. The descriptions of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

Workstation: as used herein refers to any area wherein one or more devices, tools, or components configured to perform a task may be located. In some aspects, a workstation may comprise at least one structure, such as an audio engineering station, a sound mixing board, a computer desk, or a gaming station, as non-limiting examples. By way of example and not limitation, a workstation may be configured for use in one or more of a variety of industries and activities, such as music, video, broadcast, multimedia producing, scholastic endeavors, or business implementations. In some aspects, a workstation may be configured for use in the culinary arts settings, artistic environments, or any industry that may at least partially rely on having a plurality of devices, tools, or components configured in near proximity to each other to accomplish a task or work on a project, as non-limiting examples.

Productivity facilitating apparatus: as used herein refers to any system that may be temporarily or permanently configured upon or integrated with at least one portion of a workstation to facilitate an increase in productivity for at least one user of the workstation. By way of example and not limitation, a productivity facilitating apparatus may comprise any apparatus that may be configured to at least temporarily house one or more workstation devices, tools, or other components within at least one mobile assembly that may be moved in and out of the way to allow for streamlined access thereto on an as-needed basis, which may increase a user's productivity.

Figure 1B:
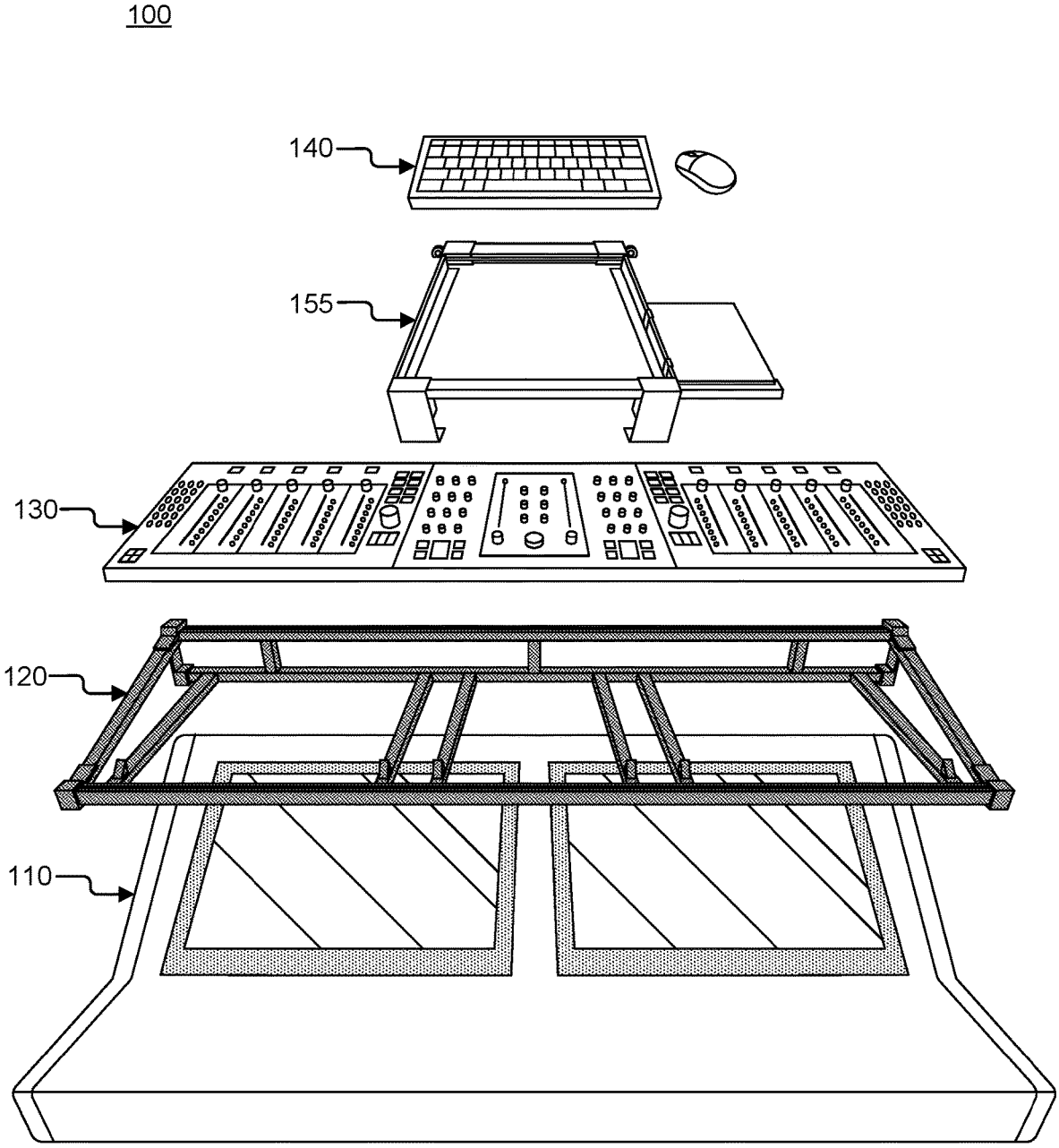
FIG. 1B illustrates an exploded view of an exemplary productivity facilitating apparatus configured for integration with a workstation, according to some embodiments of the present disclosure.

Referring now to FIGS. 1A-1B, an exemplary productivity facilitating apparatus 100 integrated with a workstation 110, included an exploded view thereof, according to some embodiments of the present disclosure, is illustrated. In some embodiments, the productivity facilitating apparatus 100 may be integrated with one or more of a variety of workstations 110 to allow for increased utility and productivity. For example, the productivity facilitating apparatus 100 may be integrated with an audio engineering station 110 by positioning a virtual fader pack 130 within a base 120 of the productivity facilitating apparatus 100, wherein the base 120 may be temporarily or permanently secured to a top portion of surface of the audio engineering station 110. In some implementations, this may secure the audio mixer in place within the productivity facilitating apparatus 100 and allow a user to work without the worry of the virtual fader pack 130 moving.

In some aspects, the productivity facilitating apparatus 100 may comprise a structure that may allow the productivity facilitating apparatus 100 to be configured for use with one or more of a variety of different devices, tools, components, or accessories 130, 140, such as a virtual fader pack 130, as a non-limiting example. In some aspects, the productivity facilitating apparatus may be integrated with one or more accessories 130, 140 when such accessories 130, 140 may be temporarily or permanently secured within or upon one or more portions of the productivity facilitating apparatus 100, or when the accessories 130, 140 may be connected to the productivity facilitating apparatus 100 either manually or electronically.

In some non-limiting exemplary embodiments, one or more workstation input devices. peripheral devices, or accessories 130, 140, such as a keyboard, pointing device, or headphones, as non-limiting examples, may be electronically connected to the productivity enhancing apparatus 100. By way of example and not limitation, such electronic connection may be facilitated by one or more Universal Serial Bus (or "USB") connectors. In some aspects, the productivity facilitating apparatus 100 may comprise at least one mobile assembly 155 configured to at least temporarily receive and house one or more workstation input devices, peripheral devices, or accessories 130, 140, such as a pointing device and a keyboard, as non-limiting examples. In some implementations, this may allow for a user to easily access the workstation accessories 130, 140 as needed by moving the mobile assembly 155 along a track to allow access to various portions of the workstation 110, which may allow a user to optimize the potentially limited space of the workstation 110 by temporarily positioning one or more workstation accessories 140 above one or more other workstation accessories 130, such as when the mobile assembly 155 may be moved to a primary work location of the workstation 110 when the accessories 140 are needed, and the mobile assembly 155 may be moved away from the primary work location when the accessories 140 are not needed.

In some aspects, the productivity facilitating apparatus 100 may be temporarily or permanently secured upon a top portion of a workstation 110 that comprises at least one substantially flat planar surface. In some non-limiting exemplary embodiments, a top surface of the workstation 110 may comprise any geometric shape. By way of example and not limitation, a workstation 110 surface may comprise a round, square, oblong, or rectangular shape, as non-limiting examples. In some aspects, the workstation 110 may be configured in one or more of a variety of positions and orientations. By way of example and not limitation, a workstation 110 may comprise a desk, tabletop, countertop, or any surface capable of receiving at least a portion of the productivity facilitating apparatus 100. By way of example and not limitation, a workstation 110 may comprise at least one accessory 130 wherein the accessory 130 may be integrated within or upon at least one portion of the productivity facilitating apparatus 100.

In some aspects, the at least one accessory 130, 140 may comprise one or more sound boards, audio mixing equipment, cooking utensils, art supplies, education supplies, study materials, gaming controllers, monitors, speakers, writing utensils, or headphones, as non-limiting examples. In some aspects, the productivity facilitating apparatus 100 may be configured to at 5 least temporarily secure one or more accessories, equipment, or technologies 130 in place. For example, the productivity facilitating apparatus 100 may be configured to secure a soundboard to the base 120 of the productivity facilitating apparatus 100, and this may allow a user to focus on a task without the worry of the soundboard moving.

In some aspects, the productivity facilitating apparatus 100 may comprise at least one mobile assembly 155. In some aspects, the mobile assembly 155 may be configured to hold one or more accessories 140, such as a keyboard and a mouse, as non-limiting examples. In some aspects, the mobile assembly 155 may move along at least one portion of the productivity facilitating apparatus 100. This may allow a user to fully optimize the workstation 110. For example, the space of a workstation 110 may be limited, and the mobile assembly 155 may allow the user to include accessories 140 in a workstation 110 that would otherwise not fit in the workstation 110 surface area. In some aspects, the mobile assembly 155 may be moved to either side of the productivity facilitating apparatus 100 when a user needs to access the accessories 130 that may be temporarily blocked by the mobile assembly 155.

Figure 2A:
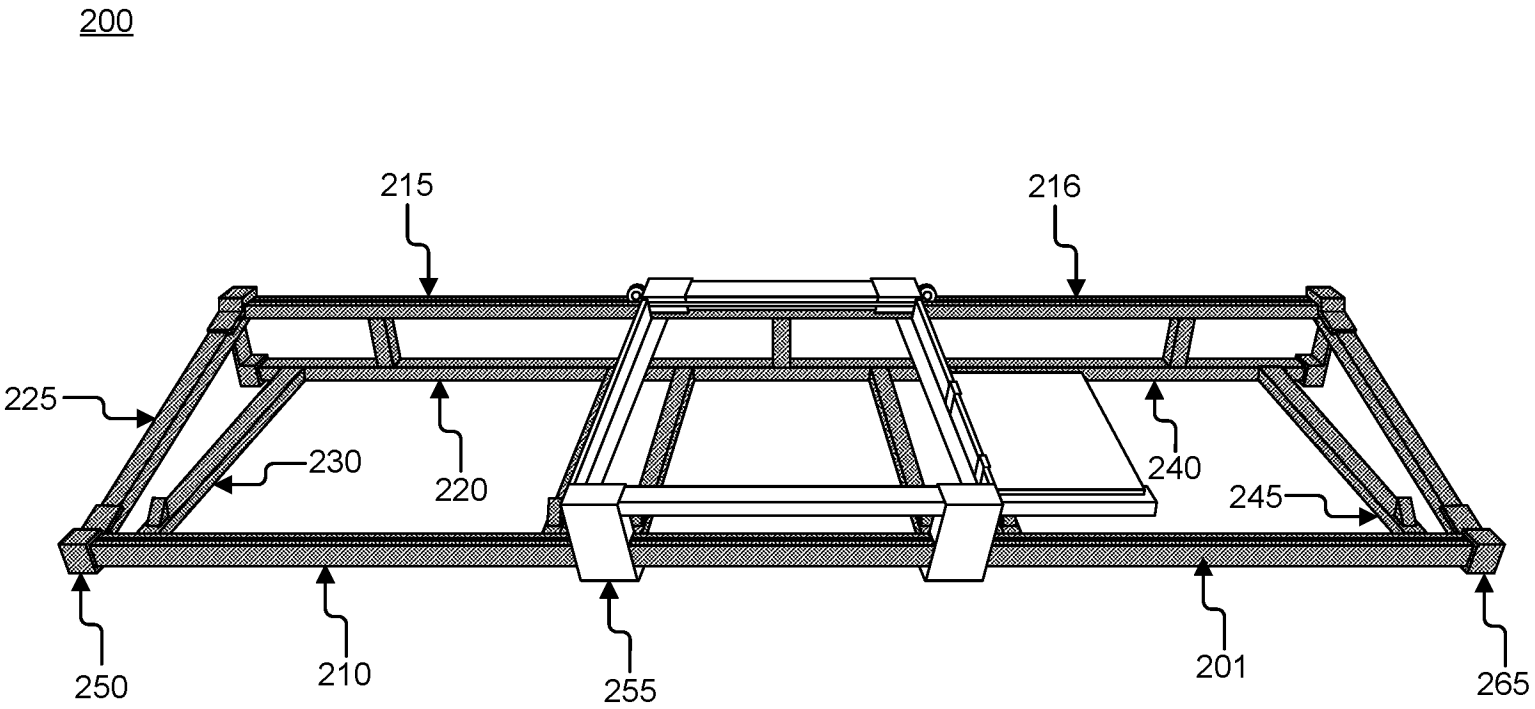
FIG. 2A illustrates an exemplary productivity facilitating apparatus, according to some embodiments of the present disclosure.
Figure 2B:
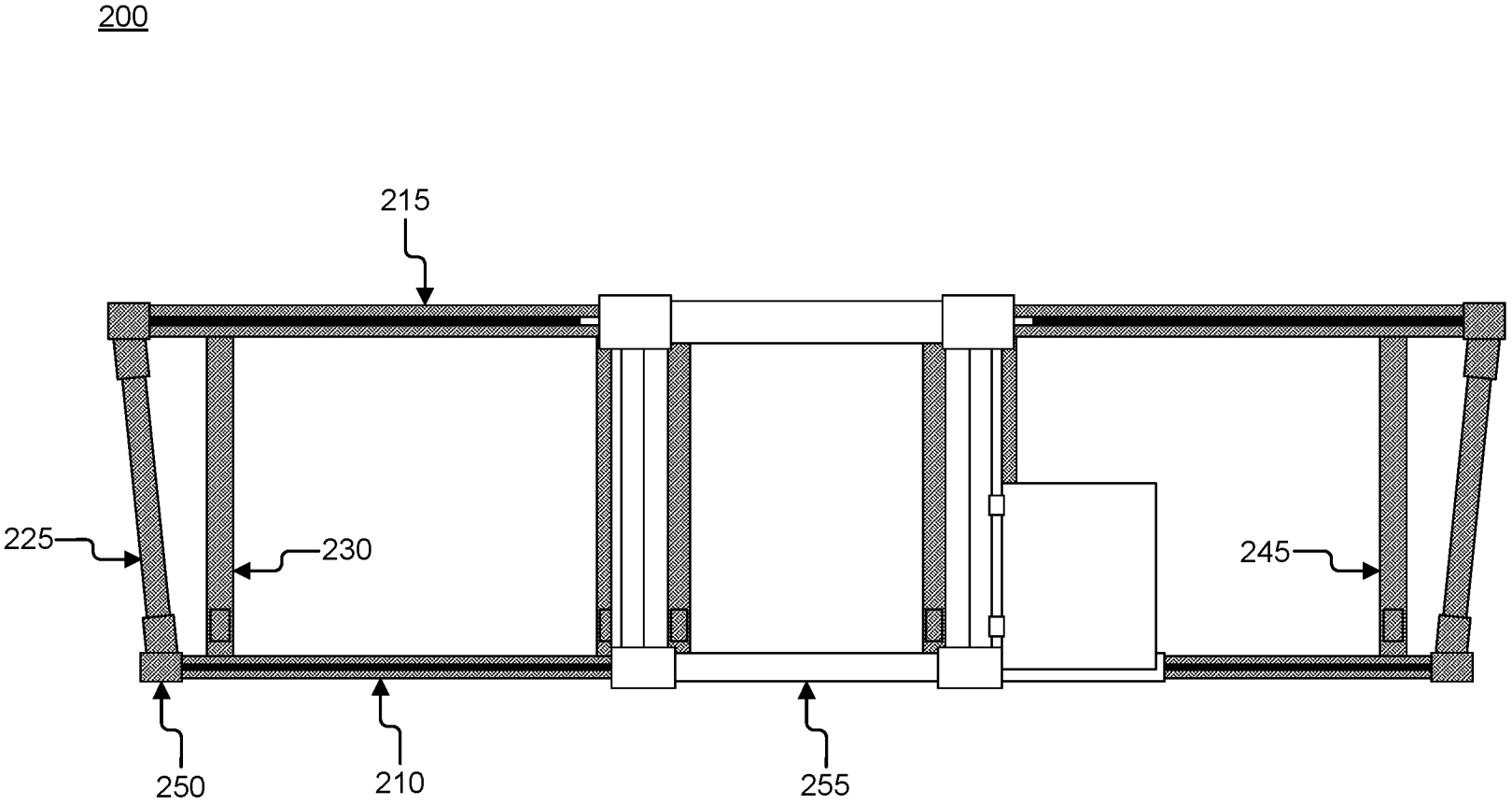
FIG. 2B illustrates a top view of an exemplary productivity facilitating apparatus, according to some embodiments of the present disclosure.
Figure 2C:
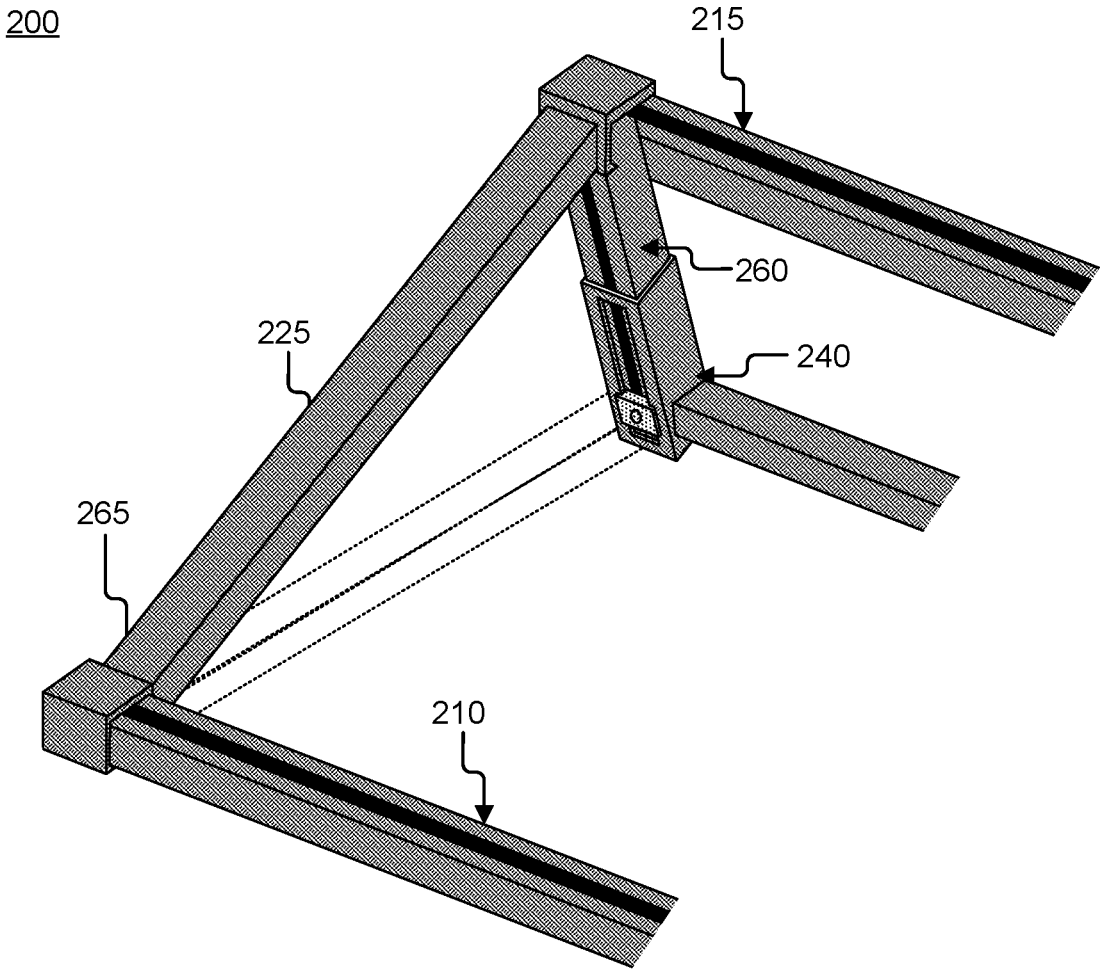
FIG. 2C illustrates an exemplary productivity facilitating apparatus, according to some embodiments of the present disclosure.

Referring now to FIGS. 2A, 2B, and 2C, an exemplary productivity facilitating apparatus 200, including a top view thereof, according to some embodiments of the present disclosure, is illustrated. In some implementations, a productivity facilitating apparatus 200 may comprise at least one base 201. In some aspects, the at least one base 201 may comprise at least two coplanar elongated members 210, 220 within a first planar portion of the base 201. By way of example and not limitation, the at least one base 201 may be configured to interface with at least one workstation accessory, such as an audio mixer, soundboard, or computer hardware, as non-limiting examples.

In some aspects, the at least one base 201 may comprise a first elongated member 210 and a second elongated member 220. In some embodiments, the workstation accessory may be positioned between the first elongated member 210 and the second elongated member 220. In some aspects, the first elongated member 210 may be coplanar with the second elongated member 220, wherein both elongated members 210, 220 may be temporarily or permanently secured on a substantially flat surface.

In some aspects, the productivity facilitating apparatus 200 may comprise at least one track 216. In some embodiments, the track 216 may comprise at least one elongated groove, indentation, or channel. In some embodiments, the track 216 may comprise a third elongated member 215 of the productivity facilitating apparatus 200. In some aspects, the third elongated member 215 may be configured within a second planar portion of the base 201, wherein the first elongated member 210 also comprises the second planar portion. In some implementations, the third elongated member 215 may be positioned above the second elongated member 220 of the base. By way of example and not limitation, the track 216 of the third elongated member 215 may facilitate translational movement of the mobile assembly 255.

By way of example and not limitation, the mobile assembly 255 may move along the track 216 on the third elongated member 215 to expose one or more workstation accessories positioned within or upon the base 201. This may enhance productivity by allowing a user to access different accessories that may help them work on or complete a task on an as-needed basis. For example, the mobile assembly 255 may move along the track 216 of the third elongated member 215 to provide access to one or more portions of an audio mixer that may be at least temporarily blocked by the mobile assembly 255.

In some embodiments, the productivity facilitating apparatus 200 may comprise at least one cross member 230, wherein opposing ends of the cross member 230 may interface with different portions of the base 201. By way of example and not limitation, the cross member 230 may connect the first elongated member 210 to the second elongated member 220. In some implementations, the cross member 230 may be positioned in the same plane as the first and second elongated members 210, 220. In some aspects, the cross member 230 may comprise a first end and a second end, and the first end and the second end of the cross member 230 may be connected to different portions of the at least one base 201. By way of example and not limitation, the cross member 230 may be perpendicular to the first elongated member 210 and the second elongated member 220.

By way of further example and not limitation, the productivity facilitating apparatus 200 may comprise a plurality of cross members 230. In some implementations, the productivity facilitating apparatus 200 may comprise six cross members 230. This may allow for the placement of workstation accessories or technologies onto or the crossmembers 230 or within open spaces between the cross members 230, which may enhance the convenience of using the accessories or technologies. For example, an audio mixer may be positioned upon the crossmembers 230, between the first and second elongated members 210, 215 of the base 201, which would facilitate secure placement of the audio mixer.

By way of example and not limitation, a sound board or audio mixing station may be placed onto the plurality of cross members 230. In some aspects, at least one of the cross members 230 may comprise at least one raised element 245, wherein the raised element 245 may be configured to fasten accessories or technological devices in place. For example, the raised element 245 of the cross members 230 may allow for a secure fit of technological devices within the productivity facilitating apparatus 200 by securing the technological devices between the raised element 245 and the second elongated member 220.

This secure fit may lead to increased productivity and use of a workstation because unwanted movement of the technological devices from the productivity facilitating apparatus 200 may be minimized or prevented. By way of example and not limitation, if a workstation accessory does not fit exactly between the elongated members 210, 220, of the base 201 because the accessory may not comprise exact dimensions corresponding to the physical area, the raised element 245 may facilitate a secure fit by filling in the areas that the workstation accessory may not. The raised element 245 may allow the productivity facilitating apparatus 200 to be versatile to accommodate many different workstations of different sizes and shapes.

In some implementations, the productivity facilitating apparatus 200 may comprise at least one support member 225, wherein the support member 225 may connect the first elongated member 210 to the third elongated member 215. In some aspects, the support member 225 may comprise a first end and a second end. In some aspects, the first end may connect to a distal end of the first elongated member 210 and the second end may connect to a corresponding distal end of the third elongated member 215. In some aspects, the connection of the first or second end of the support member 225 and the distal end of the first 210 or third 215 elongated member may comprise at least one cover 250. In some embodiments, the cover 250 may comprise a variety of one or more materials such as plastic, metal, or silicone. By way of example and not limitation, the cover 250 may facilitate the connection of the support member 225 to the distal end of the first 210 or third 215 elongated member by securing the connection.

In some aspects, an angle may be formed between the first planar portion and the second planar portion of the productivity facilitating apparatus 200, wherein the first elongated member 210 may comprise a vertex of such angle. In some embodiments, this angle or incline may be adjustable, wherein the incline may increase or decrease by adjusting the heights or lengths of the support members 225, the cross members 230, and/or the support elements 240. By way of example and not limitation, support members 225, cross members 230, and/or support elements 240 may comprise telescoping portions 260 that allow for height or length adjustment. This may allow a user of the productivity facilitating apparatus 200 to adjust the height of the productivity facilitating apparatus 200 to better suit their needs and increase productivity. For example, a user who has placed the productivity facilitating apparatus 200 on a standing desk may need to adjust this incline to match their own height. In some aspects, this adjustment of the angle of the incline may be facilitated by any mechanical or electrical adjustment method, such as a motor, pulley system, or pivot point 265, as non-limiting examples.

In some aspects, the productivity facilitating apparatus 200 may be configured to remember a user's preferred positions, and the productivity facilitating apparatus 200 may be configured to relocate to those preferred positions upon the happening of an event, such as when a specific user engages with the productivity facilitating apparatus 200 or with engagement of a button, switch, or other activation mechanisms, as non-limiting examples. This may allow a user to reduce time in adjusting the productivity facilitating apparatus 200 and increase productivity. In some aspects, the productivity facilitating apparatus 200 may be configured to be adjusted remotely.

In some aspects, the productivity facilitating apparatus 200 may comprise one or more hardware components configured to be interacted with, both directly and remotely by a user, such as a computing device, power source, sensor, transmitter, processor, or storage medium. In some aspects, the hardware components may allow a user to interact and adjust the productivity facilitating apparatus 200 in ways that would increase utility of a workstation and increase productivity. In some aspects, the productivity facilitating apparatus 200 may comprise at least one electrical component, such as USB connection, charging stations, audio connectors, cooling mechanisms such as fans, transmitting devices, or sensors, as non-limiting examples.

In some aspects, the productivity facilitating apparatus 200 may be configured to interact with at least one software application. By way of example and not limitation, the productivity facilitating apparatus 200 may be adjusted or interacted with by a user via the software application. In some aspects, a user may engage with the software application to increase or decrease the height of the productivity facilitating apparatus 200. In some implementations, a user may indicate a preferred position for the productivity facilitating apparatus 200 for different conditions. For example, a user may indicate a preferred position during the day and a different preferred position during the evening, as the user transitions from using the workstation for different activities, such as from work to gaming. In some aspects, a user may engage with the software application to activate, adjust, or deactivate any hardware integrated into the productivity facilitating apparatus 200. For example, a productivity facilitating apparatus 200 may comprise a light fixture, and a user may turn on, adjust the brightness or color, and turn off the light fixture through the software application.

In some aspects, the productivity facilitating apparatus 200 may comprise at least one support element 240. In some implementations, the support element 240 may connect the second elongated member 220 to the third elongated member 215. In some aspects, the support element 240 may comprise a first end and a second end, and the first end and the second end of the support element 240 may be perpendicular to the second elongated member 220 and the third elongated member 215. By way of example and not limitation, the productivity facilitating apparatus 200 may comprise a plurality of support elements 240. In some implementations, the productivity facilitating apparatus 200 may comprise five support elements 240. In some embodiments, the support elements 240 may be configured to increase or decrease in height. This may allow a user to adjust the height of the productivity facilitating apparatus 200 to better suit their needs and increase productivity.

In some aspects, the productivity facilitating apparatus 200 may comprise at least one mobile assembly 255. In some aspects, the mobile assembly 255 may comprise at least one frame, wherein the at least one frame may be configured to be movable along the at least one track 216. In some embodiment, the mobile assembly 255 may connect to the first elongated member 210 and the third elongated member 215 via one or more connection mechanisms. In some aspects, the first elongated member 210 and the third elongated member 215 may each comprise a track to facilitate translational movement of at least one rolling mechanism. In some aspects, a rolling mechanism may comprise one or more rollers or wheels. In some embodiments, at least a portion of a first and second roller may fit into the track on the first and third elongated member 210, 215 and at least a portion of a third roller may interact with a bottom portion of the first and third elongated member 210, 215 to facilitate movement of the mobile assembly 255 along the elongated members 210, 215.

In some aspects, the mobile assembly 255 may be configured to hold one or more workstation accessories such as a keyboard and a mouse. In some aspects, the mobile assembly 255 may move along the first and third elongated members 210, 215 while holding workstation accessories. This may allow a user to fully optimize their workstation. For example, the space of a workstation may be limited, and the mobile assembly 255 may allow for a user to include accessories in a workstation that would otherwise not fit. In some aspects, the mobile assembly may be moved to either side of the productivity facilitating apparatus 200, when a user needs to access the accessories secured within or upon the base 201.

Figure 3:
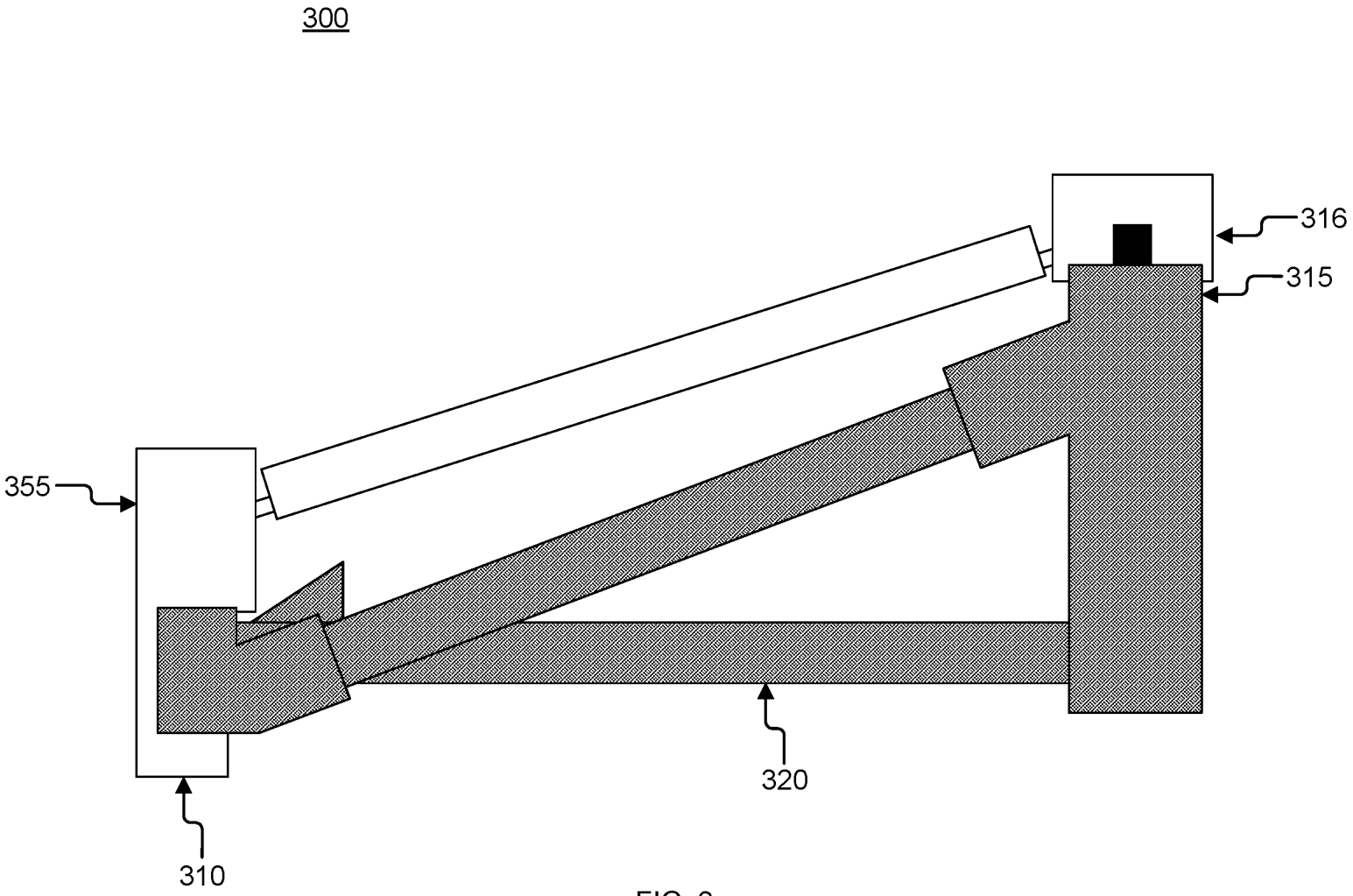
FIG. 3 illustrates a side view of an exemplary productivity facilitating apparatus, according to some embodiments of the present disclosure.

Referring now to FIG. 3, a side view of an exemplary productivity facilitating apparatus 300, according to some embodiments of the present disclosure, is illustrated. In some aspects, the productivity facilitating apparatus 300 may comprise at least one mobile assembly 355. In some embodiment, the mobile assembly 355 may interface with one or more tracks 316 or other portions of the base 320. In some embodiments, the mobile assembly 355 may connect the first elongated member 310 and the third elongated member 315 via one or more connection mechanisms 355. In some aspects, a connection mechanism 355 may comprise a clip, magnet, or snapping mechanism, as non-limiting examples. This may allow the mobile assembly 355 to move securely along the track 316, which may allow for workstation accessories located on or within the mobile assembly 355 to remain secured. This may allow a user to enhance their productivity using the producing facilitating apparatus 300.

In some aspects, the first elongated member 310 and the third elongated member 315 may each comprise a track 316 to receive at least one movement mechanism. In some aspects, the movement mechanism may comprise a rolling mechanism, sliding mechanism, or one or more magnetically-driven elements, as non-limiting examples. In some aspects, a rolling mechanism may comprise one or more rollers or wheels. In some embodiments, at least a portion of a first and/or second roller may fit on a track on the first and third elongated member 310, 315 and at least a portion of a third roller may interact with a bottom portion of the first and third elongated member 310, 315 to facilitate movement of the mobile assembly 355 along the elongated members 310, 315. This may allow a user to enhance their productivity using the producing facilitating apparatus 300.

Figure 4:
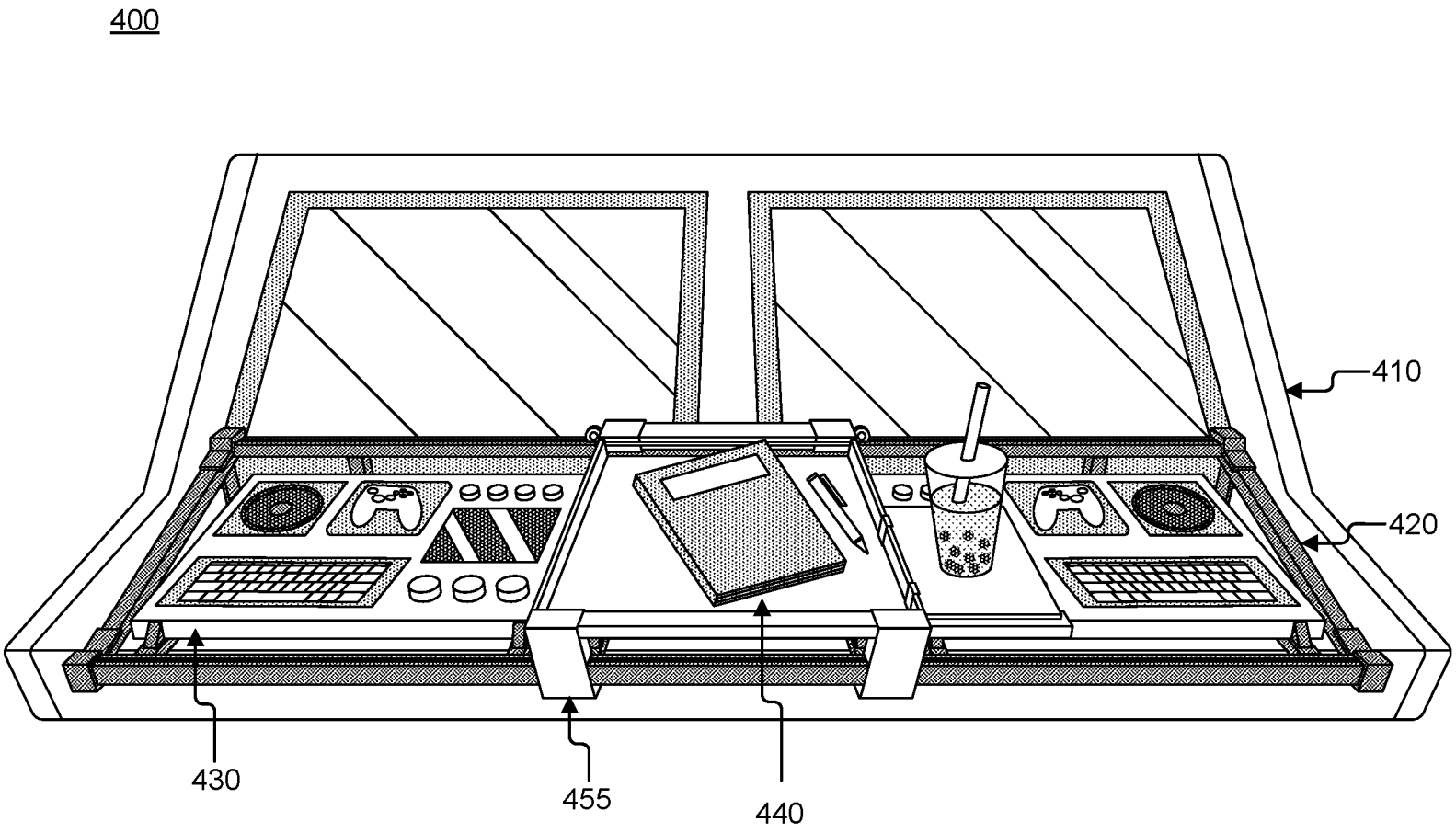
FIG. 4 illustrates an exemplary productivity facilitating apparatus integrated with a workstation, according to some embodiments of the present disclosure.

Referring now to FIG. 4, an exemplary productivity facilitating apparatus 420 integrated into a workstation 410, according to some embodiments of the present disclosure, is illustrated. In some embodiments, the productivity facilitating apparatus 400 may be integrated with one or more of a variety of workstations 410. For example, the productivity facilitating apparatus 400 may be integrated with a gaming station 410 by positioning the computer hardware and gaming accessories 430 within the base 420 of the productivity facilitating apparatus 400, as a non-limiting example. This may secure the gaming accessories in place within the productivity facilitating apparatus 400.

In some aspects, the productivity facilitating apparatus 400 may comprise a structure that may allow for integration of any workstation accessory 430, 440, such as an audio or sound mixer, as a non-limiting example, wherein integration may comprise placing the accessory 430, 440 within or upon the productivity facilitating apparatus 400 or connecting the accessory to the productivity facilitating apparatus manually or electronically. For example, a gaming controller may be connected to an integrated power source of the productivity facilitating apparatus 400 to allow the gaming controller to receive an electrical charge. This may allow a user to play games with a fully charged controller. By way of further example and not limiting, a workstation accessory, such as headphones, may connect electronically to the productivity enhancing apparatus 420. This may allow a user to potentially charge their wireless headphones.

In some aspects, the productivity facilitating apparatus 400 may comprise a mobile assembly 455 configured to at least temporarily receive or house one more workstation accessors 430, 440, such as notebook, writing utensils, or beverages, as non-limiting examples. This may allow for a user to easily access workstation accessories by moving the mobile assembly 455 along a track to allow access to other areas of a workstation. By way of example and not limitation, a user may move the mobile assembly 455 when using the workstation to play games, while still having access to writing materials and beverages. This may allow a user to optimize the potentially limited space of a workstation by allowing a user to temporarily position workstation accessories above other workstation accessories. In some aspects, the mobile assembly 455 may be configured to temporarily lock into place on the track to prevent the mobile assembly 455 from being moved unintentionally.

Figure 5A:
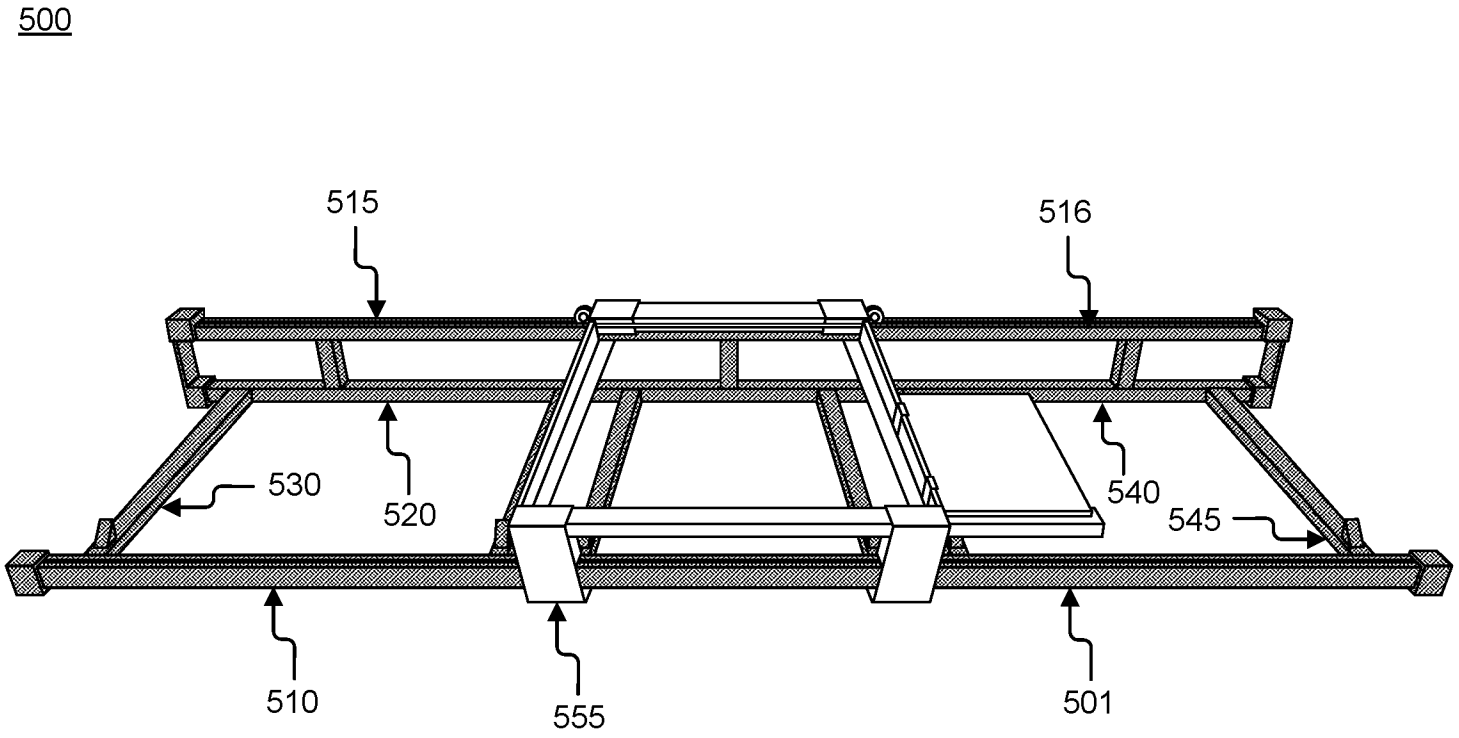
FIG. 5A illustrates an exemplary productivity facilitating apparatus, according to some embodiments of the present disclosure.
Figure 5B:
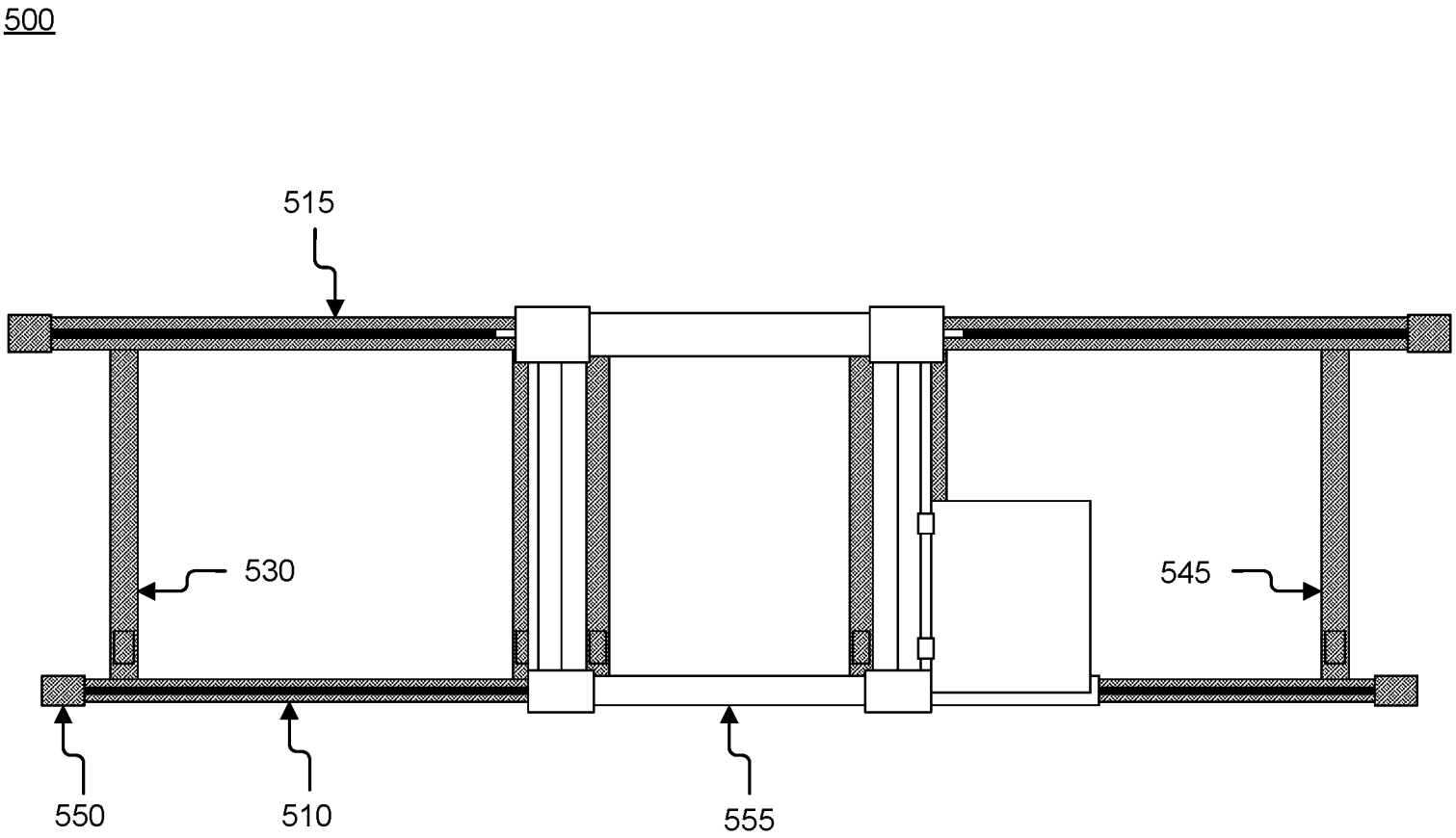
FIG. 5B illustrates a top view of an exemplary productivity facilitating apparatus, according to some embodiments of the present disclosure.

Referring now to FIGS. 5A and 5B, an exemplary productivity facilitating apparatus 500, according to some embodiments of the present disclosure, is illustrated. In some implementations, a productivity facilitating apparatus 500 may comprise at least one base 501. In some aspects, the at least one base 501 may comprise at least two coplanar elongated members 510, 520 within a first planar portion of the base 501. By way of example and not limitation, the at least one base 501 may be configured to interface with at least one workstation accessory, such as an audio mixer, soundboard, or computer hardware, as non-limiting examples. In some aspects, the at least one base may comprise a first elongated member 510 and a second elongated member 520. In some embodiments, the workstation accessory may be positioned between the first elongated member 510 and the second elongated member 520. In some aspects, the first elongated member 510 may be coplanar with the second elongated member 520, wherein both elongated members 510, 520 may temporarily or permanently secured upon a substantially flat surface.

In some aspects, the productivity facilitating apparatus 500 may comprise at least one track 516. In some embodiments, the track 516 may comprise at least one elongated groove, indentation, or channel. In some embodiments, the track 516 may comprise a third elongated member 515 of the productivity facilitating apparatus 500. In some aspects, the third elongated member 515 may be positioned within a second planar portion of the base 501, wherein the first elongated member 510 also comprises the second planar portion. In some implementations, the third elongated member 515 may be positioned above the second elongated member 520 of the base. By way of example and not limitation, the track 516 on the third elongated member 515 may facilitate movement of the mobile assembly 555. By way of example and not limitation, the mobile assembly 555 may move along the track 516 on the third elongated member 515 to expose workstation accessories positioned within or upon the base 501. This may enhance productivity by allowing a user to access all accessories that may help them work on or complete a task. For example, the mobile assembly 555 may move along the track 516 on the third elongated member 515 to expose one or more portions of an audio mixer.

In some embodiments, the productivity facilitating apparatus 500 may comprise at least one cross member 530, wherein the cross member 530 may interface with one or more portions of the base 501. By way of example and not limitation, each cross member 530 may connect the first elongated member 510 to the second elongated member 520. In some implementations, each cross member 530 may be positioned in the same plane as the first and second elongated members 510, 520. In some aspects, each cross member 530 may comprise a first end and a second end, and the first end and the second end of each cross member 530 may be connected to different portions of the at least one base 501. By way of example and not limitation, each cross member 530 may be perpendicular to the first elongated member 510 and the second elongated member 520.

By way of further example and not limitation, the productivity facilitating apparatus 500 may comprise a plurality of cross members 530. In some implementations, the productivity facilitating apparatus 500 may comprise six cross members 530. This may allow for the placement of workstation accessories or technologies onto the crossmembers 530 or within open areas between the cross members 530, and this may enhance the convenience of using the accessories or technologies. For example, an audio mixer may be positioned on the crossmembers 530, between the first and second elongated members 510, 515 of the base 501, which may facilitate secure placement of the audio mixer.

By way of example and not limitation, a sound board or audio mixing station may be placed onto the plurality of cross members 530. In some aspects, at least one cross member 530 may comprise at least one raised element 545, wherein the raised element 545 may be configured to fasten accessories or technology in place. For example, the raised element 545 of each cross member 530 may allow for a secure fit of technology within the productivity facilitating apparatus by securing the technology between the raised element 545 and the second elongated member 520. This secure fit may lead to increased productivity and use of the workstation because the technology may be at least partially restrained from moving from the productivity facilitating apparatus 500. By way of example and not limitation, if a workstation accessory does not fit exactly between the elongated members 510, 520, of the base 501 because the accessory may not comprise the exact dimensions, the raised element 545 may facilitate a secure fit by filling in the areas that the workstation accessory may not. The raised element 545 may allow the productivity facilitating apparatus 500 to be versatile to accommodate many different workstations.

In some aspects, the productivity facilitating apparatus 500 may comprise at least one support element 540. In some aspects, each support element 540 may connect the third elongated member 515 to the second elongated member 520 of the at least one base 501. In some aspects, each support element 540 may comprise a first end and a second end, and the first end and the second end of the support element 540 may be perpendicular to the second elongated member 520 and the third elongated member 515. By way of example and not limitation, the productivity facilitating apparatus 500 may comprise a plurality of support elements 540. In some implementations, the productivity facilitating apparatus 500 may comprise five support elements 540. In some embodiments, the support elements 540 may be configured to increase or decrease in height. This may allow a user to adjust the height of the productivity facilitating apparatus 500 to better suit their needs and increase productivity.

In some aspects, the productivity facilitating apparatus 500 may comprise at least one mobile assembly 555. In some aspects, the mobile assembly 555 may comprise at least one frame, wherein the at least one frame may be configured to be movable along the at least one track 516. In some embodiments, the mobile assembly 555 may connect to the first elongated member 510 and the third elongated member 515 via one or more connection mechanisms. In some aspects, the first elongated member 510 and the third elongated member 515 may each comprise a track to facilitate movement of at least one rolling mechanism. In some aspects, a rolling mechanism may comprise one or more rollers or wheels. In some embodiments, at least a portion of a first roller and a second roller may fit into the track on the first and third elongated member 510, 515 and at least a portion of a third roller may interact with a bottom portion of the first and third elongated member 510, 515 to facilitate movement of the mobile assembly 555 along the elongated members 510, 515.

In some aspects, the mobile assembly 555 may be configured to hold workstation accessories such as a keyboard and a mouse. In some aspects, the mobile assembly 555 may move along the first and third elongated members 510, 515 while holding workstation accessories. This may allow a user to fully optimize their workstation. For example, the space of a workstation may be limited, and the mobile assembly 555 may allow for a user to include accessories in a workstation that would otherwise not fit. In some aspects, the mobile assembly may be moved to either side of the productivity facilitating apparatus 500, when a user needs to access the accessories secured within or upon the base 501. In some aspects, the mobile assembly 555 may be configured to temporarily lock into place on the track to prevent the mobile assembly 555 from being moved unintentionally.

Figure 6A:
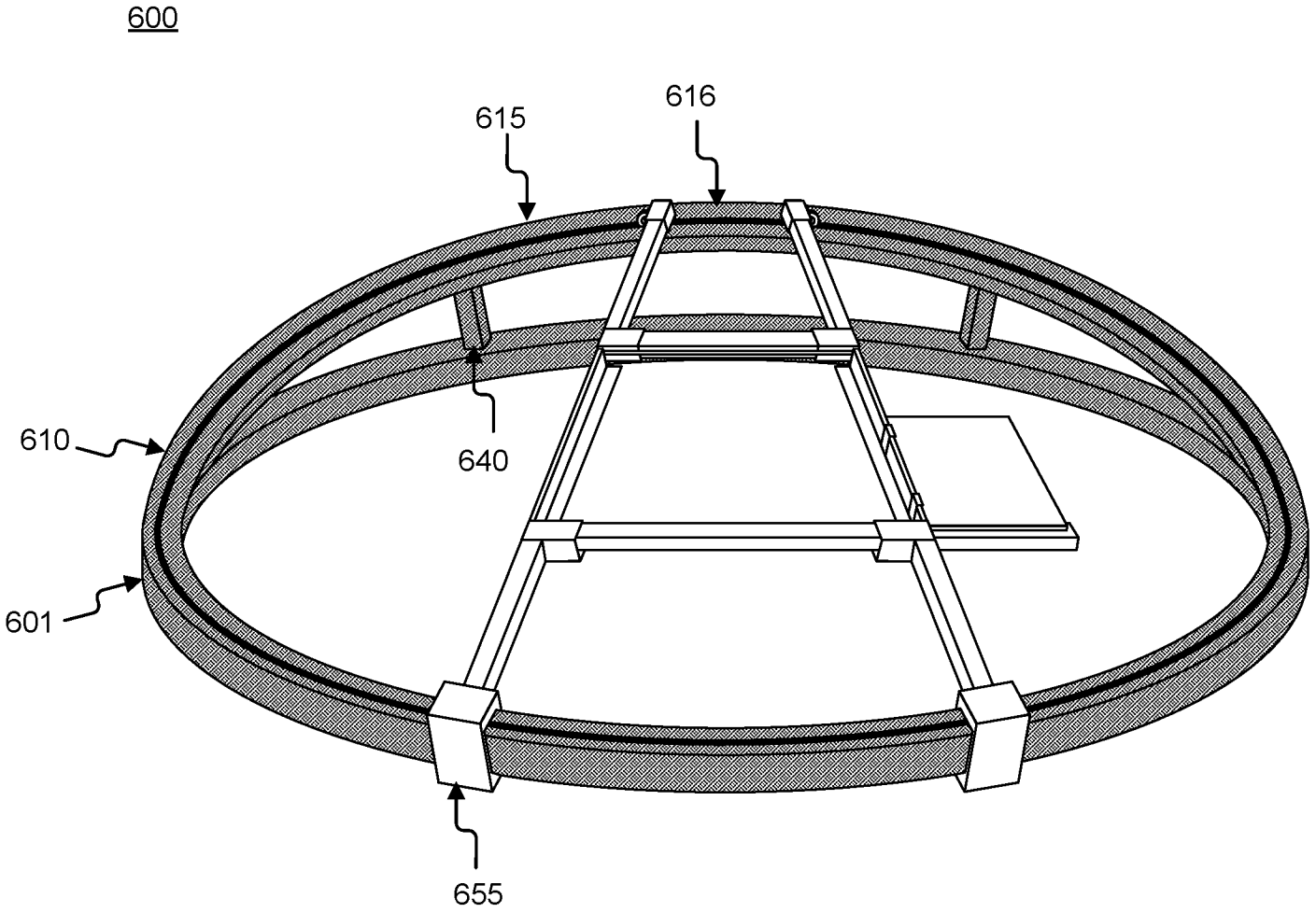
FIG. 6A illustrates an exemplary productivity facilitating apparatus, according to some embodiments of the present disclosure.
Figure 6B:
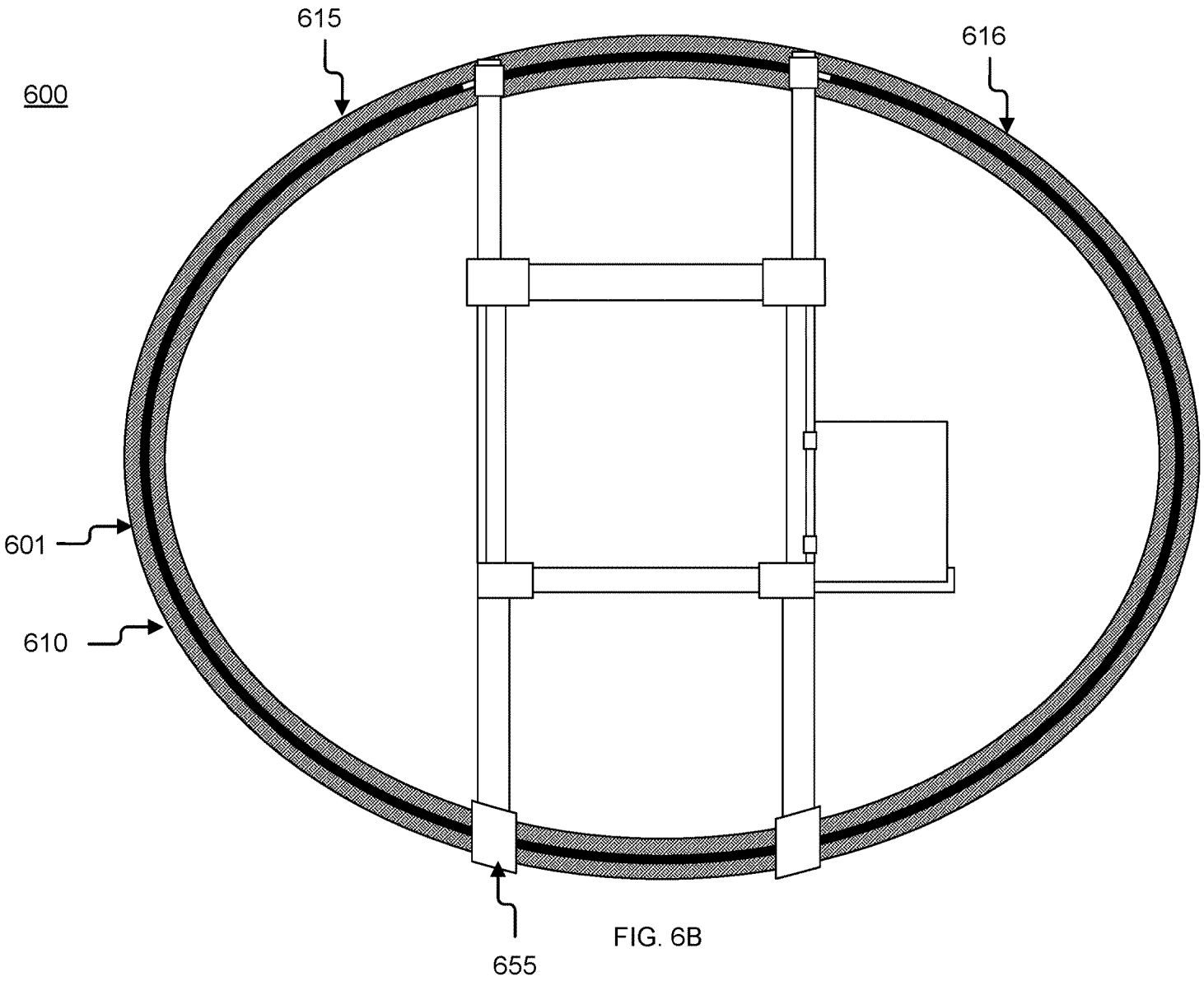
FIG. 6B illustrates a top view of an exemplary productivity facilitating apparatus, according to some embodiments of the present disclosure.

Referring now to FIGS. 6A and 6B, an exemplary productivity facilitating apparatus 600, according to some embodiments of the present disclosure, is illustrated. In some implementations, a productivity facilitating apparatus 600 may comprise at least one base 601. In some aspects, the at least one base 601 may comprise one continuous substantially circular elongated member 610. By way of example and not limitation, the at least one base 601 may be configured to interface with at least one workstation accessory, such as an audio mixer, soundboard, or computer hardware, as non-limiting examples. In some embodiments, the workstation accessory may be positioned within the circular base 601.

In some aspects, the productivity facilitating apparatus 600 may comprise at least one track 616. In some aspects, the third elongated member 615 may be positioned in the plane above the base 601. In some embodiments, a third elongated member 615 may connect seamlessly with the base 601. By way of example and not limitation, the track 616 on the third elongated member 615 may facilitate movement of the mobile assembly 655. By way of example and not limitation, the mobile assembly 655 may move along the track 616 on the third elongated member 615 to expose workstation accessories positioned upon or within the base 601. This may enhance productivity by allowing a user to access all accessories that may help them work on or complete a task. For example, the mobile assembly 655 may move along the track 616 on the third elongated member 615 to expose one or more portions of an audio mixer.

In some aspects, the productivity facilitating apparatus 600 may comprise at least one support element 640. In some aspects, each support element 640 may connect the third elongated member 615 to the circular elongated member 610. By way of example and not limitation, the productivity facilitating apparatus 600 may comprise a plurality of support elements 640. In some implementations, the productivity facilitating apparatus 600 may comprise five support elements 640. In some embodiments, the support elements 640 may be configured to increase or decrease in height. This may allow a user to adjust the height of the productivity facilitating apparatus 600 to better suit their needs and increase productivity.

In some aspects, the productivity facilitating apparatus 600 may comprise at least one mobile assembly 655. In some aspects, the mobile assembly 655 may comprise at least one frame, wherein the at least one frame may be configured to be movable along the at least one track 616. In some embodiments, the mobile assembly 655 may connect to the circular elongated member 610 and the third elongated member 615 via one or more connection mechanisms. In some aspects, the circular elongated member 610 and the third elongated member 615 may each comprise a track to facilitate motion of at least one movement mechanism. In some aspects, each movement mechanism may comprise at least one rolling mechanism. In some aspects, the rolling mechanism may comprise one or more rollers or wheels.

In some embodiments, at least a portion of a first roller and a second roller may fit into the track on the circular and third elongated member 610, 615 and at least a portion of a third roller may interact with a bottom portion of the circular and third elongated member 610, 615 to facilitate movement of the mobile assembly 655 along the elongated members 610, 615. In some aspects, the mobile assembly 655 may be configured to hold workstation accessories such as a keyboard and a mouse. In some aspects, the mobile assembly 655 may move along the first and third elongated members 610, 615 while holding workstation accessories. This may allow a user to fully optimize their workstation. For example, the space of a workstation may be limited, and the mobile assembly 655 may allow for a user to include accessories in a workstation that would otherwise not fit. In some aspects, the mobile assembly 655 may be moved to either side of the productivity facilitating apparatus 600 when a user needs to access the accessories secured within or upon the base 601.

Figure 7A:
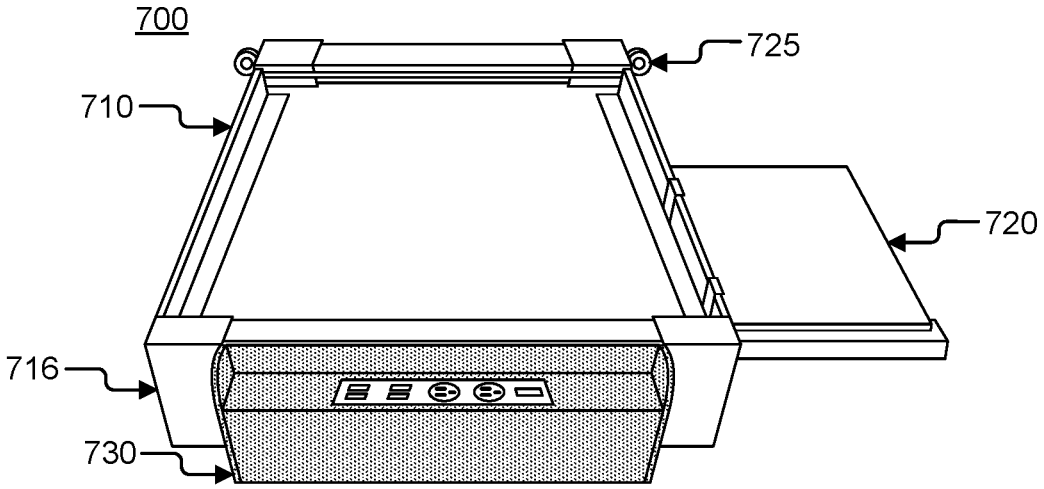
FIG. 7A illustrates an exemplary mobile assembly for a productivity facilitating apparatus, according to some embodiments of the present disclosure.
Figure 7B:
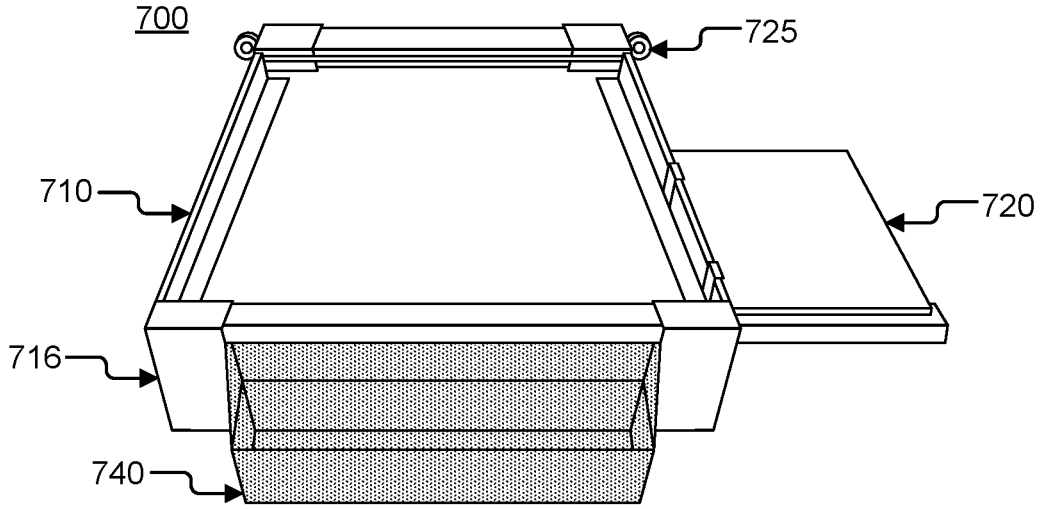
FIG. 7B illustrates an exemplary mobile assembly for a productivity facilitating apparatus, according to some embodiments of the present disclosure.
Figure 7C:
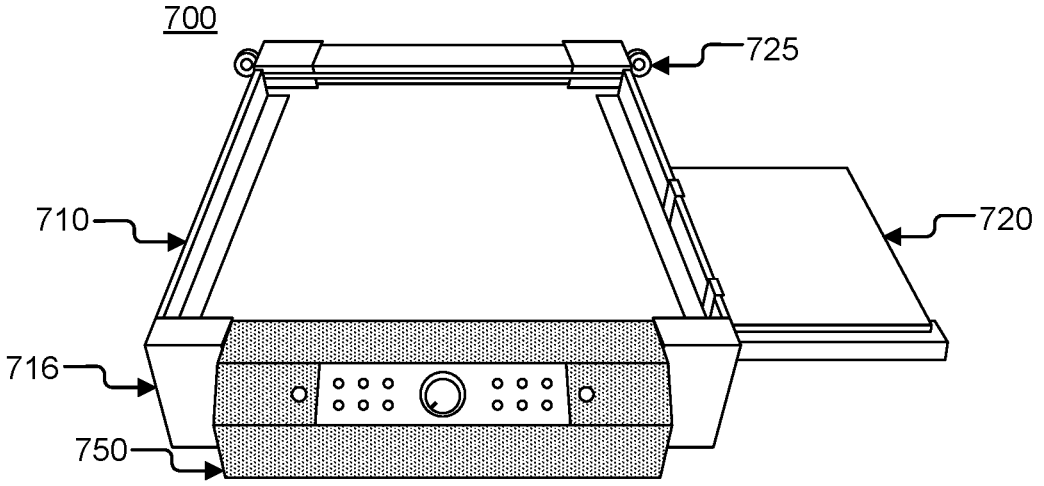
FIG. 7C illustrates an exemplary mobile assembly for a productivity facilitating apparatus, according to some embodiments of the present disclosure.

Referring now to FIGS. 7A, 7B, and 7C, an exemplary mobile assembly 700 for a productivity facilitating apparatus, according to some embodiments of the present disclosure, is illustrated. In some embodiments, a productivity facilitating apparatus may comprise at least one mobile assembly 700. In some embodiments, the mobile assembly 700 may interface with one or more tracks of a base of the productivity facilitating apparatus. In some aspects, the mobile assembly 700 may comprise at least one frame 710, wherein the at least one frame 710 may be configured to be movable along the at least one track. In some aspects, the frame 710 may be configured to move translationally in at least one direction upon the first elongated member of the productivity facilitating apparatus and the third elongated member via at least one movement mechanism 725.

By way of example and not limitation, the mobile assembly 700 may move along the track to expose workstation accessories positioned on the base of the productivity facilitating apparatus. This may enhance productivity by allowing a user to access all accessories that may help them work on or complete a task. For example, the mobile assembly 755 may move along the track on the third elongated member to expose one or more portions of an audio mixer. In some aspects, the movement mechanism 725 may comprise at least one rolling mechanism, at least one sliding mechanism, or one or more magnetically-driven elements, as non-limiting examples. In some aspects, the frame 710 may comprise plurality of connecting members 716, wherein the plurality of connecting members 716 may be configured to connect the movement mechanism 725, such as a rolling mechanism, to the first at least one elongated member and the third at least one elongated member.

In some aspects, the mobile assembly 700 may be configured to include a variety of elements that may be specific to a workstation. By way of example and not limitation, the mobile assembly 700 may comprise USB ports or power sources 730. This may allow a user to connect or charge workstation accessories with the mobile assembly 700. By way of example and not limitation, the mobile assembly 700 may comprise a storage container 740, wherein a user may store items related to the workstation. For example, a user may store pens, highlighters, or pencils within the storage container 740 to aid in their work or studies.

By way of example and not limitation, the mobile assembly 700 may comprise one or more electronic components 750 related to the workstation, such as buttons, switches, or other controls related to the accessories used in the workstation. For example, the mobile assembly 700 may comprise audio adjustment components for a workstation configured for audio production and sound mixing. In some aspects, the mobile assembly 700 may comprise a plurality of surfaces 720, wherein a user may place accessories, such as a mouse or keyboard. For example, a user may use the surfaces 720 of the mobile assembly 700 to hold their study materials or beverages.

Figure 8A:
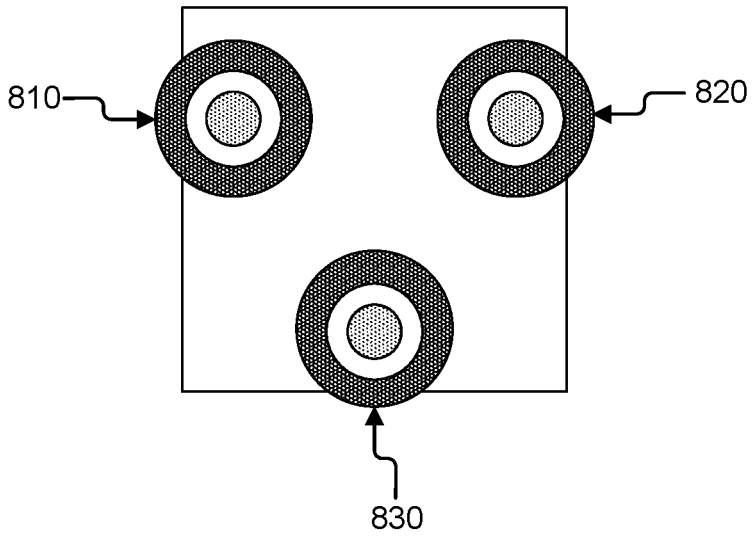
FIG. 8A illustrates an exemplary rolling mechanism for a productivity facilitating apparatus, according to some embodiments of the present disclosure.
Figure 8B:
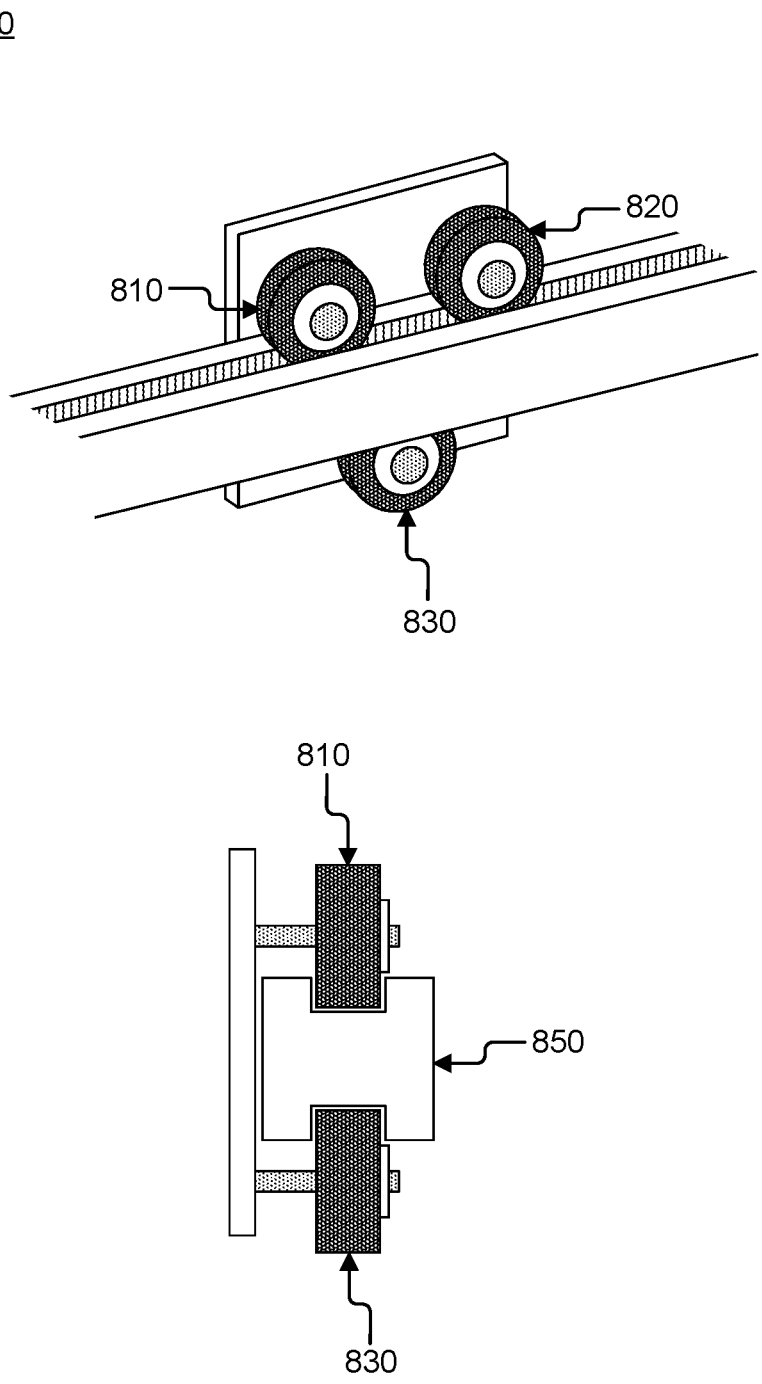
FIG. 8B illustrates an exemplary rolling mechanism for a productivity facilitating apparatus, according to some embodiments of the present disclosure.

Referring now to FIGS. 8A and 8B, an exemplary rolling mechanism 800, according to some embodiments of the present disclosure, is illustrated. In some aspects, a mobile assembly for a productivity facilitating apparatus may comprise at least one rolling mechanism 800. In some implementations, the rolling mechanism 800 may comprise one or more rollers 810, 820, 830. In some embodiments, the rolling mechanism 800 may comprise a first roller 810, a second roller 820, and a third roller 830 wherein the first roller 810 and the second roller 820 may be positioned above the third roller 830, and wherein the centers of the first roller 810 and the second roller 820 may be linearly aligned.

In some embodiments, at least a portion of the first roller 810 and the second roller 820 may fit into at least one track on the elongated members 850 of the productivity facilitating apparatus and at least a portion of the third roller 830 may be configured to interact with a bottom portion of the first and third elongated member 850 to facilitate movement of the mobile assembly along the elongated members 850. In some aspects, the first roller 810 and the second roller 820 may be positioned in the top track of the elongated members 850, and the third roller 830 may be positioned in the bottom track of the elongated members 850. This may allow a user to easily move the mobile assembly and to optimize the space of the workstation. By way of example and not limitation, the mobile assembly may move along the track, via a movement mechanism, to expose workstation accessories positioned upon or within the base of the productivity facilitating apparatus. This may enhance productivity by allowing a user to access all accessories that may help them work on or complete a task.

Figure 9:
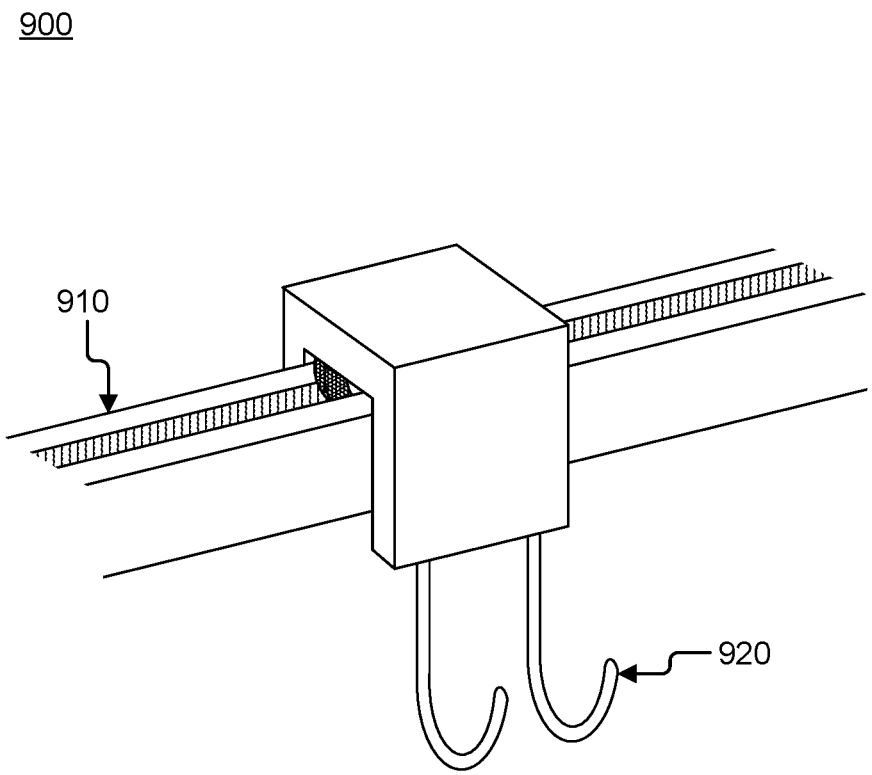
FIG. 9 illustrates an exemplary attachment mechanism for a productivity facilitating apparatus, according to some embodiments of the present disclosure.

Referring now to FIG. 9, an exemplary attachment mechanism 900 for a productivity facilitating apparatus, according to some embodiments of the present disclosure, is illustrated. In some aspects, a productivity facilitating apparatus may comprise at least one attachment mechanism 900. In some implementations the attachment mechanism 900 may be configured to removably receive at least one workstation accessory. By way of example and not limitation, the attachment mechanism 900 may be configured to hold or contain workstation accessories, and the use of the attachment mechanism 900 may lead to further optimization of a workstation. For example, the attachment mechanism 900 may comprise a hook 920, and a user may place their headphones on the hook, saving space on the workstation.

In some aspects, the attachment mechanism 900 may be configured to be attached to the elongated members of the base 910 of the productivity facilitating apparatus. In some aspects, the attachment mechanism 900 may be configured to utilize the track of the elongated members 910 to facilitate attachment. By way of example and not limitation, the attachment mechanism may clip onto the track of the elongated members 910, securing its position on the productivity facilitating apparatus. In some embodiments, the attachment mechanism 900 may comprise a variety of elements that may aid in the optimization of a workstation. By way of example and not limitation, the attachment mechanism 900 may comprise a hook, a cupholder, a cord holder, or storage receptacle. By way of further example and not limitation, a user may utilize a cord holder attachment mechanism 900 to save vital space in their workstation, which could increase productivity.

CONCLUSION

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A productivity facilitating apparatus configured to be at least temporarily secured to a top portion of a media control station, the productivity facilitating apparatus comprising:

at least one base, wherein the at least one base comprises at least one track, a first planar portion, a second planar portion, and a first at least one support element, wherein the first at least one support element connects the first planar portion to the second planar portion; and at least one mobile assembly comprising at least one frame, wherein the at least one frame is movable along the at least one track, wherein the at least one track comprises at least one elongated channel within at least one elongated member, wherein the first planar portion comprises a first at least one elongated member and a second at least one elongated member, wherein the second planar portion comprises the first at least one elongated member and a third at least one elongated member, wherein the first at least one elongated member and the third at least one elongated member each comprise one at least one track, wherein the at least one mobile assembly comprises at least one rolling mechanism, wherein the at least one rolling mechanism comprises a first at least one roller, a second at least one roller, and a third at least one roller, wherein centers of the first at least one roller and the second at least one roller are linearly aligned, wherein at least a portion of each of the first at least one roller and the second at least one roller is received by one of: the at least one track of the first at least one elongated member and the at least one track of the third at least one elongated member, wherein each at least one track is configured within a top portion of each of the first at least one elongated member and the third at least one elongated member, wherein the third at least one roller is configured to interact with a bottom portion of one of: the first at least one elongated member and the third at least one elongated member.

2. The productivity facilitating apparatus of claim 1, further comprising at least one support member, wherein the at least one support member interfaces with the first at least one elongated member and the third at least one elongated member.

3. The productivity facilitating apparatus of claim 1, further comprising at least one cross member, wherein the at least one cross member interfaces with two or more portions of the at least one base.

4. The productivity facilitating apparatus of claim 1, further comprising at least one connection cover.

5. The productivity facilitating apparatus of claim 2, wherein the at least one support member comprises a first end and a second end, and wherein the first end connects to a distal end of the first at least one elongated member and the second end connects to a distal end of the third at least one elongated member.

6. The productivity facilitating apparatus of claim 5, wherein the connection of the first end of the at least support member and the distal end of the first at least one elongated member comprises at least one cover.

7. The productivity facilitating apparatus of claim 3, wherein the at least one cross member comprises a first end and a second end, and wherein the first end and the second end are connected to the two or more portions of the at least one base.

8. The productivity facilitating apparatus of claim 3, wherein the productivity facilitating apparatus comprises a plurality of the at least one cross member.

9. The productivity facilitating apparatus of claim 3, wherein the productivity facilitating apparatus comprises six of the at least one cross member.

10. The productivity facilitating apparatus of claim 7, wherein the at least one cross member is perpendicular to each of the two or more portions of the at least one base.

11. The productivity facilitating apparatus of claim 1, wherein an angle formed between the first planar portion and the second planar portion is adjustable.

12. The productivity facilitating apparatus of claim 1, wherein the first at least one support element comprises a height that is adjustable.

13. The productivity facilitating apparatus of claim 1, furthering comprising at least one attachment mechanism.

14. The productivity facilitating apparatus of claim 13, wherein the at least one attachment mechanism is configured to removably receive at least one accessory.

15. The productivity facilitating apparatus of claim 1, wherein the at least one mobile assembly comprises at least one attachment mechanism.

* * * * *